US007644592B2

(12) United States Patent
Kent

(10) Patent No.: US 7,644,592 B2
(45) Date of Patent: Jan. 12, 2010

(54) COOLING APPARATUS FOR COMESTIBLE PRODUCTS

(76) Inventor: Fred E. Kent, 5900 Davis Rd., Woodbine, MD (US) 21797

( * ) Notice: Subject to any disclaimer, the term of this patent is extended or adjusted under 35 U.S.C. 154(b) by 314 days.

(21) Appl. No.: 11/589,689

(22) Filed: Oct. 30, 2006

(65) Prior Publication Data

US 2008/0098762 A1 May 1, 2008

(51) Int. Cl.
*F25D 17/02* (2006.01)
*F25D 23/12* (2006.01)

(52) U.S. Cl. ..... 62/434; 62/258

(58) Field of Classification Search ..... 62/258, 62/246, 320, 434, 259; 99/646 C, 339; 164/4; 165/10, 80.4, 170
See application file for complete search history.

(56) References Cited

U.S. PATENT DOCUMENTS

| | | | | |
|---|---|---|---|---|
| 1,552,949 | A | 9/1925 | Platten | |
| 1,728,696 | A | 9/1929 | Platten | |
| RE17,586 | E | 2/1930 | Platten | |
| 2,248,467 | A | 7/1941 | Scilken | |
| 2,471,581 | A | 5/1949 | Poissant | |
| 2,959,941 | A | 11/1960 | McDonald | |
| 3,308,635 | A | 3/1967 | Tenniswood et al. | |
| 3,481,154 | A | 12/1969 | Johnson | |
| 3,799,107 | A * | 3/1974 | Sumner | 116/268 |
| 4,189,928 | A | 2/1980 | Cerny | |
| 4,288,991 | A | 9/1981 | Weeks | |
| 4,306,616 | A | 12/1981 | Woods, Jr. et al. | |
| 4,762,327 | A | 8/1988 | Gomez | |
| 5,921,096 | A * | 7/1999 | Warren | 62/185 |
| 6,039,114 | A * | 3/2000 | Becker et al. | 165/170 |
| 6,085,535 | A | 7/2000 | Richmond et al. | |
| 6,145,333 | A | 11/2000 | Richmond et al. | |
| 6,220,047 | B1 * | 4/2001 | Vogel et al. | 62/342 |
| 6,351,963 | B2 | 3/2002 | Surber et al. | |
| 6,434,961 | B2 | 8/2002 | Richmond et al. | |
| 6,539,740 | B1 | 4/2003 | Santana, Jr. | |
| 6,722,150 | B1 | 4/2004 | Carr et al. | |
| 6,735,971 | B2 | 5/2004 | Monroe et al. | |
| 2005/0066683 | A1 | 3/2005 | Schwichtenberg et al. | |

* cited by examiner

*Primary Examiner*—Frantz F Jules
*Assistant Examiner*—Emmanuel Duke

(57) ABSTRACT

A cooling apparatus comprises one or more cooling stations for installation in a support structure to provide a chilled surface for supporting a receptacle holding a comestible product. Each cooling station has a housing for being installed in the support surface and a cooling disc assembly mounted on the housing. The chilled surface is formed by a top disc of the cooling disc assembly in direct contact with a chilled fluidic cooling medium circulated through a cooling chamber of the cooling disc assembly. The housing provides a thermal barrier around the cooling disc assembly. The chilled surface provides heat transfer between the comestible product and the fluidic cooling medium in the cooling chamber to maintain the comestible product in a cooled state.

19 Claims, 7 Drawing Sheets

COOLING APPARATUS FOR COMESTIBLE PRODUCTS

BACKGROUND OF THE INVENTION

1. Field of the Invention

The present invention relates generally to a cooling apparatus for maintaining comestible products in a cooled state during the course of being consumed. More particularly, the present invention relates to cooling apparatus installed in support surfaces on which receptacles containing comestible products are rested during the course of the products being consumed.

2. Brief Discussion of the Related Art

Comestible products such as beverages and food are normally placed in or on receptacles such as conventional drinkware and tableware that hold the comestible products during the course or process of the products being consumed by individuals. Beverages, for example, are commonly placed in a drinking receptacle that is grasped by the individual with the hand and brought to the mouth to allow the beverage to be ingested. Representative drinking receptacles include cans, glasses, bottles, mugs and cups, which may be made from various materials. During the course or process of comestible products being consumed, the receptacles containing the comestible products are ordinarily rested upon flat or horizontal support surfaces of support structures such as tables, counters and bars. Oftentimes comestible products are consumed at a leisurely or slow pace, especially in social situations and/or to extend the pleasure and enjoyment associated with the consumption of the comestible products. Accordingly, a considerable period of time can elapse during the course or process of a comestible product being consumed by an individual. Bars in particular present a situation where beverages are normally consumed over a considerable period of time due to the relaxed social atmosphere associated with bars, the recreational and entertainment benefits derived from bars, the personal enjoyment experienced by bar patrons, and the prudence of consuming alcoholic beverages at a slow pace. During the course of beverages being consumed by individuals at bars and similar establishments, the drinking receptacles containing the beverages typically remain rested upon the support surface for relatively long segments of time between relatively short segments of time during which the drinking receptacles are removed from the surface by the individuals and brought to the mouth to be actively ingested. In the case of bars, the support surface is ordinarily a bar top or counter top associated with chairs or stools to provide seating for a plurality of individuals at locations along the support surface.

Many comestible products, including many various beverages commonly served at bars, are intended to be consumed and/or taste best when consumed while in a cooled or chilled state that is colder than the temperature of the ambient environment. In addition, many comestible products, including various beverages, are perishable or contain ingredients susceptible to spoilage if not maintained in a cooled or chilled state. However, thermal transfer with the ambient environment results in loss or diminishment of the cooled or chilled state for the comestible products and makes it difficult to retain the products in their cooled or chilled state throughout the course or process of the products being consumed. Comestible products that are initially in a cooled or chilled state at the beginning of the course or process of being consumed by individuals will thusly become warmer during the time that elapses until the course or process of being consumed is terminated or completed, resulting in decreased satisfaction and enjoyment for the individuals as well as possible spoilage of the comestible products. Where the cooled or chilled comestible products are consumed over a considerable period of time, as is typical for cooled or chilled beverages served at bars and similar establishments, the problem of retaining the cooled or chilled state of the products throughout the course or process of being consumed is made more difficult. Furthermore, the preferred temperature for the cooled or chilled state for many comestible products, including many cooled or chilled beverages, is significantly colder or lower than the temperature of the ambient environment and may be close to freezing temperature. Since comestible products are most commonly consumed in indoor environments having ambient temperatures in the normal room temperature range, a large temperature differential may exist between the ambient temperature and the preferred temperature for the cooled or chilled state of the comestible products, which adds to the difficulty of maintaining the cooled or chilled state of the products. Bars and similar establishments are commonly located in indoor environments and are sometimes located in warmer outdoor environments where there is an even greater differential between the ambient temperature and the preferred temperature for the cooled or chilled state of the beverages.

Another problem associated with the thermal transfer that occurs between cooled or chilled comestible products and the ambient environment is that the receptacles containing the cooled or chilled comestible products may "sweat" due to condensation formed on the outer surfaces of the receptacles. In the case of drinking receptacles and other receptacles that are commonly grasped by individuals with the hand, the presence of condensation on the receptacles may make the receptacles slippery to the hand and may present a risk that the receptacles will be dropped. A receptacle that is dropped because of the slipperiness caused by condensation is problematic due to the comestible product being lost through spillage, the potential damage to clothing and nearby objects from contact with the spilled product, and/or the potential personal injury and/or property damage in the event of breakage or shattering of the receptacle. When a receptacle that has condensation thereon is manually grasped by an individual with the hand, some of the condensation will ordinarily be transferred to the hand resulting in discomfort and annoyance for the individual. Furthermore, when a receptacle that has condensation thereon is rested upon a support surface, some of the condensation may be transferred to the support surface. The condensation that is transferred from a receptacle to the support surface may create a messy situation requiring that the moisture be wiped away from the support surface and, depending on the material from which the support surface is made, the moisture could cause damage to the support surface. The presence of condensation on receptacles may also cause the receptacles to be slippery with respect to the support surface, such that the receptacles may slide on the support surface or otherwise become unstable and present a risk of toppling or tipping over.

It is common for beverages to be placed in drinking receptacles along with ice in an attempt to keep the beverages cold during the course or process of being consumed. The ice, however, will nonetheless melt over time, causing the beverages to become warmer. Furthermore, the water that results from melting of the ice dilutes the beverages and consequently impairs the taste and flavor of the beverages. Drinking receptacles containing beverages and ice are also particularly susceptible to "sweating" with its attendant disadvantages. Some drinking receptacles, such as cans and bottles, are not designed to have ice placed therein due to the fact that standard ice cubes are too large to fit through the access openings of the receptacles. In order for canned and bottled beverages to be served with ice, the beverages must be poured from the cans or bottles into other drinking receptacles that have access openings large enough to accommodate the introduction of ice. It has also been proposed to serve beverages in pre-chilled drinking receptacles, but this approach has disadvantages similar to those of drinking receptacles containing beverages and ice.

It has been proposed to provide bar tops with ice "rails" or "spots" comprising containers that are filled with water, which is then frozen in order to cool beverages contained in receptacles placed in the containers. Ice "rails" or "spots" develop an increasing ice build-up that requires regular scraping to remove the excess ice. Receptacles placed on ice "rails" or "spots" in order to cool the beverages therein tend to slide on the slippery surfaces of the ice "rails" or "spots". Moreover, the temperature of ice being about 31° F. limits the thermal heat loss from the beverages and, therefore, limits the temperature or extent to which the beverages can be cooled. Ice "ovals" that accommodate the drinking receptacles of a plurality of individuals have also been proposed for use in bars. In addition to having disadvantages similar to those of ice "rails" or "spots", ice "ovals" being designed for group use limits the bar patron's freedom to choose where to sit or stand and also creates possible confusion as to the ownership of the various drinking receptacles placed thereon.

Another approach to maintaining the cooled state of beverages consumed in bars involves the use of cold plates that are placed in a freezer in order to be chilled and are then set on the bar top in order to support drinking receptacles thereon. The cold plates become warmer with the elapse of time and need to be rechilled on a regular frequent basis. In addition, the cold plates "sweat", which may create a slippery surface for the drinking receptacles thereon and may cause moisture to be transferred from the cold plates onto the bar top.

Refrigerated surfaces for comestible products or for receptacles containing comestible products are represented by U.S. Pat. No. Re. 17,586 and U.S. Pat. No. 1,552,949 to Platten, U.S. Pat. No. 5,921,096 to Warren, U.S. Pat. Nos. 6,085,535, 6,145,333 and 6,434,961 to Richmond et al, and by U.S. Patent Application Publication No. US 2005/0066683 A1 to Schwictenberg et al. U.S. Pat. No. Re. 17,586 and U.S. Pat. No. 1,552,949 to Platten and U.S. Patent Application Publication No. US 2005/0066683 A1 to Schwictenberg et al pertain to refrigerated surfaces on which food is prepared or displayed. The Platten patents relate to a refrigerated counter that is cooled by a network of cooling pipes in heat transfer relation with a lower surface of the counter. Heat is conducted through the counter itself to the network of cooling pipes, and the arrangement of the cooling pipes beneath the counter results in uneven or non-uniform cooling of the upper surface of the counter on which food is intended to be displayed. The Schwictenberg et al patent application publication pertains to a refrigerated work surface that is in principle similar to that of the Platten patents. Schwictenberg et al relies on the restricted circulation of a liquid coolant, which can be glycol, through a cooling element disposed beneath the work surface. The use of glycol as a cooling medium for food containers is illustrated by U.S. Pat. Nos. 6,085,535, 6,145,333 and 6,434,961 B2 to Richmond et al and U.S. Pat. No. 5,921,096 to Warren. The Platten, Warren and Richmond et al patents and the Schwictenberg patent application publication intentionally restrict or constrain the flow of fluidic coolant by causing it to flow in a circuitous path through and/or around narrow structures such as tubes, coils, pans, baffles and the like. The Richmond et al patents are illustrative of devices in which liquid glycol in contact with the refrigerated surface is cooled by a fluidic coolant circulating through tubes, but the glycol itself does not circulate.

U.S. Pat. No. 6,351,963 B2 to Surber et al pertains to a speed rail for use behind a bar to store and chill beverage containers prior to being served to patrons. The speed rail includes a housing defining a chamber for holding a plurality of beverage containers and a refrigeration system for supplying a heat transfer medium to a fluid passageway within the interior of the housing.

U.S. Pat. No. 2,959,941 to McDonald is representative of an apparatus used to chill beverage glasses prior to the beverage glasses being supplied with a beverage. The glasses are required to be placed in an inverted or upside down orientation on refrigerated arbors complementary in shape to the interior of the glasses.

SUMMARY OF THE INVENTION

The present invention is generally characterized in a cooling apparatus for installation in a support structure having a support surface upon which a comestible product, or a receptacle holding the comestible product, is rested or supported, such as during the course of the comestible product being consumed. The cooling apparatus comprises one or more cooling stations, each cooling station including a housing for being installed in the support structure and a cooling disc assembly mounted on the housing. The housing for each cooling station has a top surface for being disposed along the support surface of the support structure, and especially for being aligned or substantially aligned with the support surface of the support structure, and has a cavity extending through the housing from a top of the housing to a bottom of the housing. The cooling disc assembly for each cooling station includes an enclosure for being received in the cavity of the housing, a cooling chamber within the enclosure, a fluid inlet in communication with the cooling chamber, and a fluid outlet in communication with the cooling chamber. The enclosure includes a top disc having an upper face for being disposed along the support surface of the support structure, and especially for being aligned or substantially aligned with the top surface of the housing when the cooling disc assembly is mounted on the housing with the enclosure received in the cavity of the housing. The top disc has a lower face in direct contact with a chilled fluidic cooling medium within the cooling chamber of the enclosure. The upper face of the top disc provides a chilled surface along the support surface of the support structure upon which a comestible product, or receptacle holding a comestible product, can be rested, such as during the course of the comestible product being consumed. The top disc provides heat transfer from the comestible product to the fluidic cooling medium in the cooling chamber to maintain the comestible product in a cooled state. A flow of the chilled fluidic cooling medium is supplied to the cooling chamber through the fluid inlet and is discharged from the cooling chamber through the fluid outlet in a continuous cycle. The fluid inlet has an inlet orifice through which the chilled fluidic cooling medium is supplied to the cooling chamber, and the fluid outlet has a discharge orifice through which the fluidic cooling medium from the cooling chamber is discharged. Preferably, the inlet orifice is located adjacent the lower face of the top disc at the top of the cooling chamber. The discharge orifice is preferably located at the top of the cooling chamber in communication with a recess in the lower face of the top disc such that air pockets and/or air bubbles in the cooling chamber are directed into the recess and removed via the discharge orifice. The discharge orifice preferably has a total cross-sectional discharge area smaller than the total cross-sectional inlet area of the inlet orifice to restrict or meter the discharge of fluidic cooling medium from the cooling chamber to create a positive internal pressure within the cooling chamber and ensure uniform contact of the fluidic cooling medium with the lower face of the top disc. The housing provides a thermal barrier around the cooling disc assembly, and an insulation medium can be disposed in the cavity of the housing around the cooling chamber to provide an additional thermal barrier. The housing and the cooling disc assembly can be held together structurally by the insulation medium. The fluidic cooling medium is preferably a fluidic glycol supplied to the fluid inlet of each cooling station from a refrigeration unit. The refrigeration unit includes a cooling mechanism for chilling the fluidic cooling medium, preferably to an average temperature of or about 18° F. The cooling apparatus is particularly advantageous for installation in a support structure that is a bar top or counter top to support drinking receptacles containing chilled beverages. Each cooling station can be designed so that the upper face of its top disc supports an individual drinking receptacle.

Various objects, advantages and benefits of the invention will become apparent from the following description of preferred embodiments of the invention taken in conjunction with the accompanying drawings.

DESCRIPTION OF THE PREFERRED EMBODIMENTS

Figure 1:
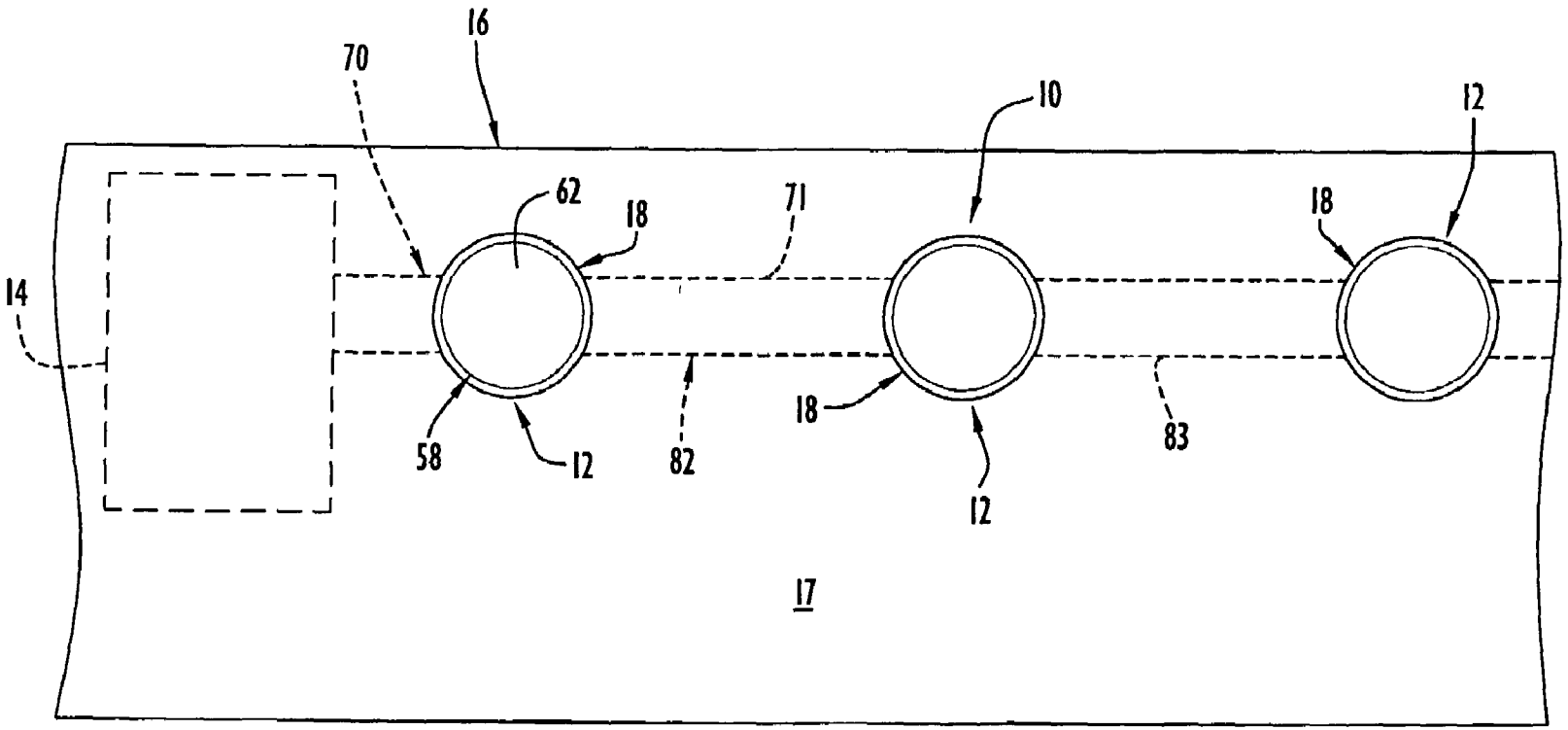
FIG. 1 is a broken, top plan view of a cooling apparatus according to the present invention depicting a plurality of cooling stations of the cooling apparatus installed in a support surface on which receptacles containing comestible products are rested during the course or process of the comestible products being consumed.
Figure 2:
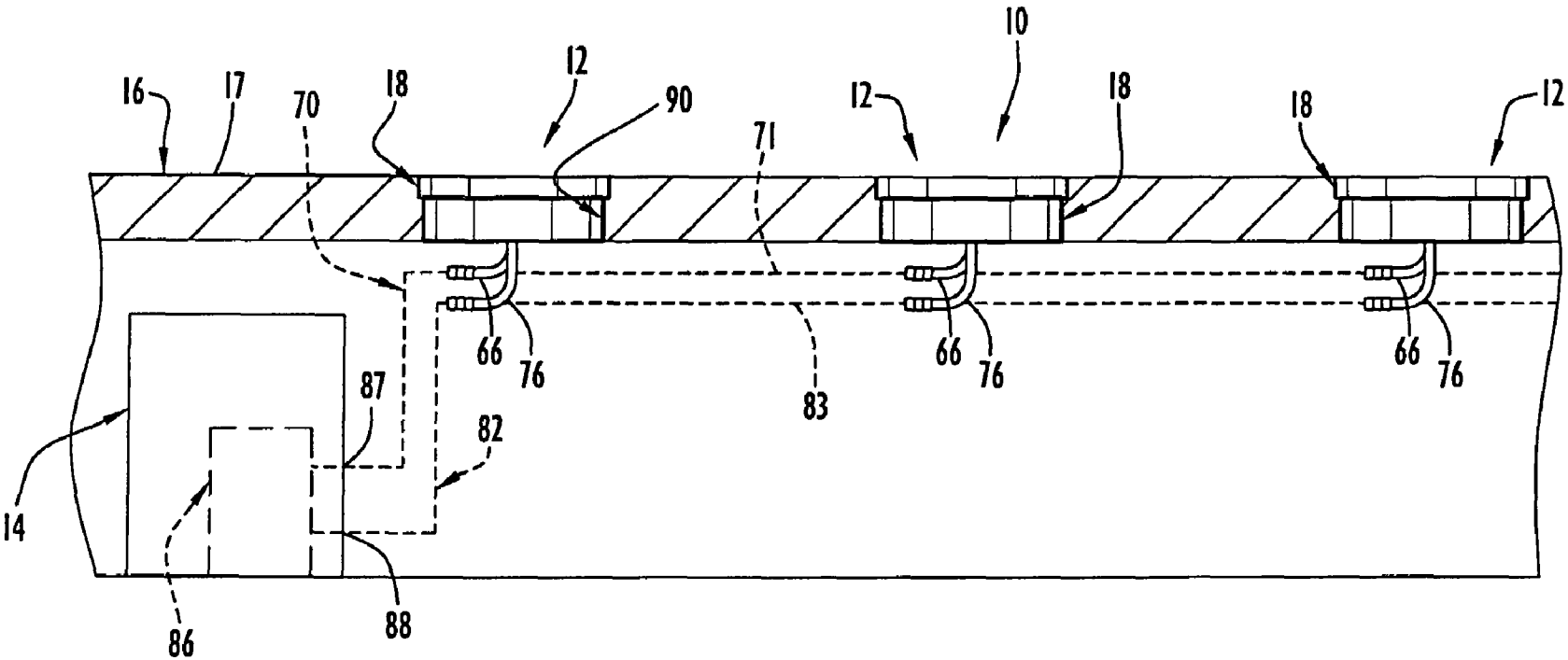
FIG. 2 is a broken side view, partly in section, of the cooling apparatus of FIG. 1.

A cooling apparatus or system 10 according to the present invention is depicted in FIGS. 1 and 2 and comprises one or more cooling stations 12 and a refrigeration unit 14 for supplying a chilled or cooled fluidic cooling medium for recirculation through the one or more cooling stations 12. The one or more cooling stations 12 are installed in a support structure 16 having a flat or horizontal upper surface 17 serving as a support surface upon which receptacles containing comestible products are rested during the course or process of the comestible products being consumed. The one or more cooling stations 12 are particularly advantageous for installation in a support structure 16 that is a bar top or counter top providing a support surface upon which drinking receptacles containing beverages are ordinarily rested during the course or process of the beverages being consumed, as commonly found in commercial or home bars, lounges, taverns, restaurants, casinos, resorts and similar establishments. Preferably, the cooling apparatus or system 10 includes a plurality of cooling stations 12 installed at spaced locations along the upper surface 17 of the support structure 16 in order for each cooling station 12 to support a single drinking receptacle in use by a single individual or patron. Where the support structure 16 is associated with seats, such as chairs or stools placed at selected locations along the support surface 17, a cooling station 12 can be provided in the support structure 16 at each site on the upper surface 17 corresponding to the location of a chair or stool. It should be appreciated, however, that any number of cooling stations 12 can be provided in the support structure 16 at any suitable location or locations. It should also be appreciated that the support structure 16 in which the one or more cooling stations 12 are installed can be an essentially fixed, permanent or non-movable support structure or can be a portable or movable support structure.

Figure 3:
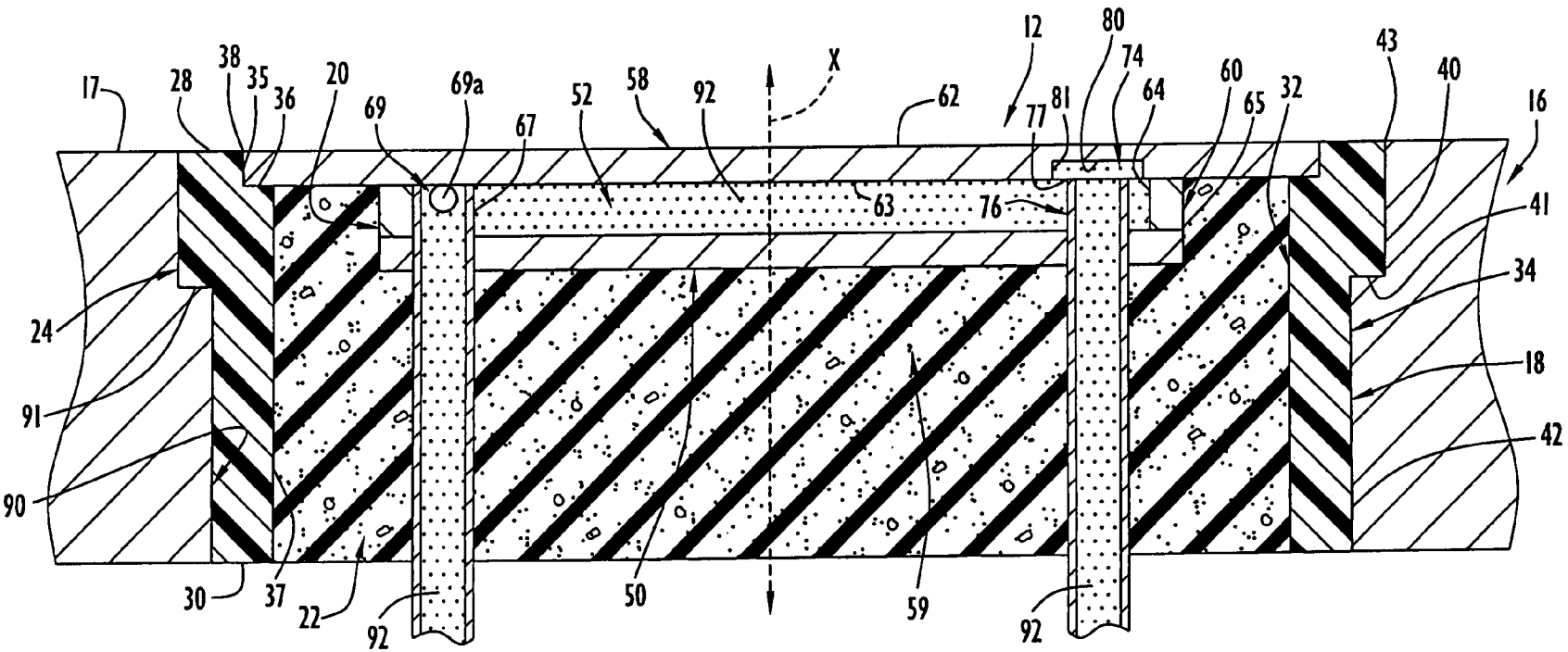
FIG. 3 is a broken, side sectional view of an individual cooling station of the cooling apparatus.
Figure 4:
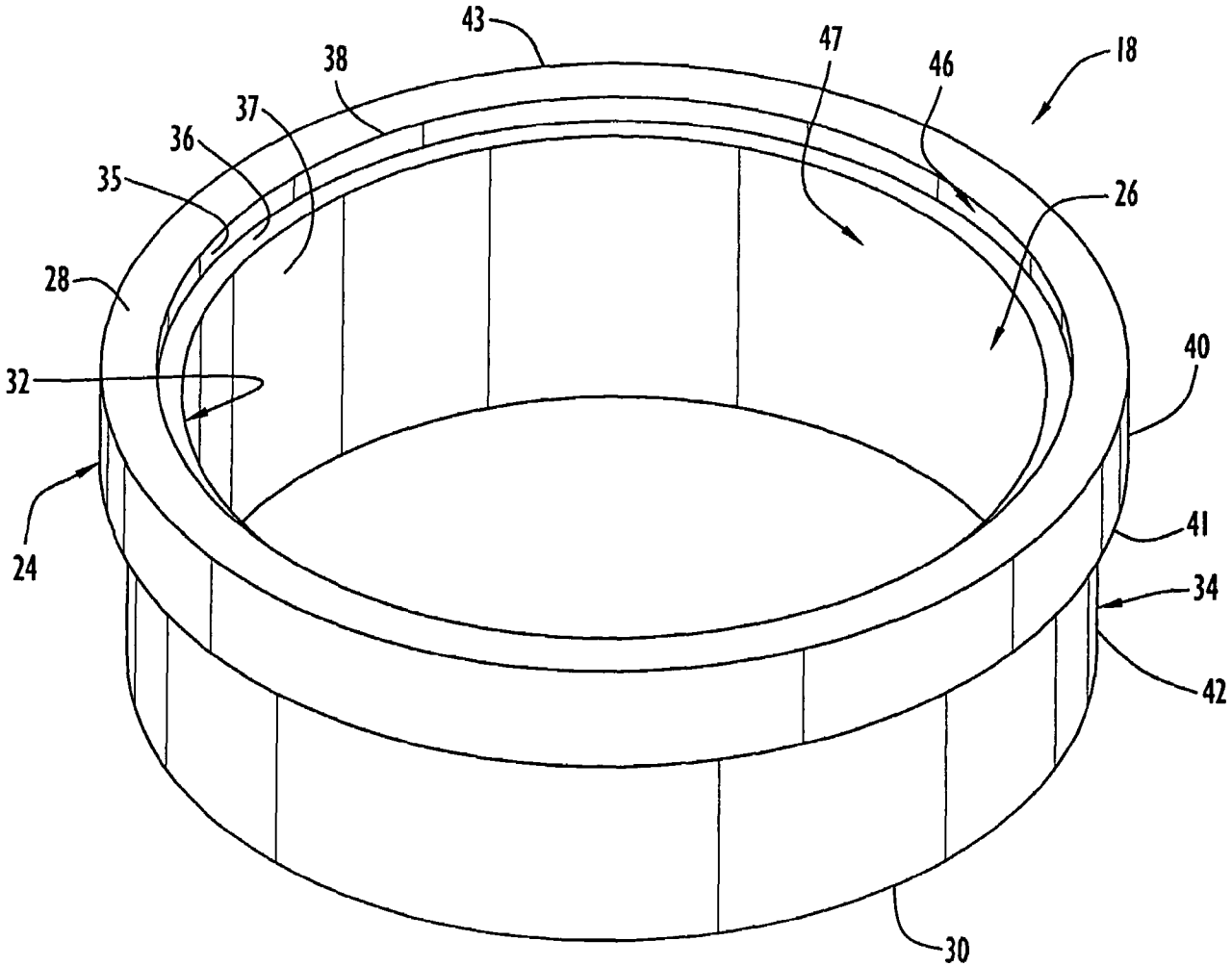
FIG. 4 is a perspective view of a housing of the cooling station.

Each cooling station 12, as best shown in FIG. 3, comprises a housing 18 installed in the support structure 16, a cooling disc assembly 20 mounted on the housing 18, and an insulation medium 22 disposed between the housing 18 and the cooling disc assembly 20. The housing 18 is best shown in FIGS. 3 and 4 and comprises a peripheral side wall 24 that circumscribes a cavity 26 extending through the housing 18 from top to bottom. The peripheral side wall 24 has a top surface 28, a bottom surface 30, an inner side surface 32, and an outer side surface 34. The inner side surface 32 comprises an upper inner side surface segment 35, a ledge surface 36, and a lower inner side surface segment 37 defining an interior stepped configuration. The upper inner side surface segment 35 is joined to the top surface 28 at an inner top peripheral edge 38, and extends downwardly from the top surface 28 to the ledge surface 36. The ledge surface 36 is recessed from the top surface 28 and extends inwardly from a bottom of the upper inner side surface segment 35 to a top of the lower inner side surface segment 37. The lower inner side surface segment 37 extends downwardly from the ledge surface 36 to the bottom surface 30 of the peripheral side wall 24.

The outer side surface 34 comprises an upper outer side surface segment 40, a shoulder surface 41, and a lower outer side surface segment 42 defining an exterior stepped configuration. The upper outer side surface segment 40 is joined to the top surface 28 at an outer top peripheral edge 43, and extends downwardly from the top surface 28 to the shoulder surface 41. The shoulder surface 41 extends inwardly from a bottom of the upper outer side surface segment 40 to a top of the lower outer side surface segment 42. The lower outer side surface segment 42 extends downwardly from the shoulder surface 41 to the bottom surface 30.

The top surface 28 is preferably flat or planar to be flush or aligned with, or to be substantially flush or aligned with, the upper surface 17 of the support structure 16 when the cooling station 12 is installed in the support structure. The top surface 28 is preferably in a plane perpendicular to a central axis x of cavity 26. The bottom surface 30 can be flat or planar and may be parallel to the top surface 28 as is the case for bottom surface 30. The ledge surface 36 and the shoulder surface 41 are preferably flat or planar and in parallel relation to the top surface 28. Preferably, the distance from the top surface 28 to the ledge surface 36 is less than the distance from the top surface 28 to the shoulder surface 41.

The inner side surface 32 peripherally circumscribes the cavity 26. As a result of the interior stepped configuration defined by inner side surface 32, the cavity 26 has an upper cavity portion 46 peripherally circumscribed by the upper inner side surface segment 35 and has a lower cavity portion 47 peripherally circumscribed by the lower inner side surface segment 37. The upper cavity portion 46 is larger in peripheral and cross-sectional size than the lower cavity portion 47. The upper cavity portion 46 is open along the top surface 28 and has a depth or height from the top surface 28 to the ledge surface 36. Preferably, the peripheral and cross-sectional size and configuration of the upper cavity portion 46 are uniform along the depth or height of the upper cavity portion 46. The lower cavity portion 47, which is smaller in peripheral and cross-sectional size than the upper cavity portion 46, has a depth or height from the ledge surface 36 to the bottom surface 30. Preferably, the peripheral and cross-sectional size and configuration of the lower cavity portion 47 are uniform along the depth or height of the lower cavity portion 47. The lower cavity portion 47 is open along the bottom surface 30. The peripheral and cross-sectional configurations and size of upper cavity portion 46, and likewise the peripheral configuration circumscribed by the upper inner side surface segment 35, correspond to the peripheral configuration of a top disc of cooling disc assembly 20 as explained further below. In the case of inner side surface 32, the upper and lower inner side surface segments 35 and 37 define concentric cylinders and circumscribe concentric circular peripheral configurations such that the upper and lower cavity portions 46 and 47 are each cylindrical with circular peripheral and cross-sectional configurations. It should be appreciated, however, that the upper and lower inner side surface segments 35 and 37, and likewise the upper and lower cavity portions 46 and 47 respectively circumscribed thereby, can have various peripheral and/or cross-sectional configurations including oval, oblong, obtuse, curving, elliptical, square, rectangular, and various polygonal configurations.

As a result of the exterior stepped configuration of the outer side surface 34, the upper outer side surface segment 40 and shoulder surface 41 form or define an enlarged external collar extending peripherally around the lower outer side surface segment 42. The upper outer side surface segment 40 defines the external peripheral and cross-sectional configurations of the collar, which are larger in size than the external peripheral and cross-sectional configurations defined by the lower outer side surface segment 42. The upper outer side surface segment 40 has a height from the top surface 28 to the shoulder surface 41 which preferably is greater than the depth of the upper cavity portion 46. Preferably, the peripheral and cross-sectional configurations defined by the upper outer side surface segment 40 are uniform along the height of the upper outer side surface segment 40. The lower outer side surface segment 42 has a height from the shoulder surface 41 to the bottom surface 30, and preferably the peripheral and cross-sectional configurations defined by the lower outer side surface segment 42 are uniform along the height of the lower outer side surface segment 42. In the case of outer side surface 34, the upper and lower outer side surface segments 40 and 42 define concentric cylinders and have concentric circular peripheral configurations. Accordingly, the external collar defined by the upper outer side surface segment 40 is cylindrical with circular external peripheral and cross-sectional configurations, and the lower outer side surface segment 42 is also cylindrical with circular external peripheral and cross-sectional configurations smaller in size than the external collar. Of course, it should be appreciated that the upper and lower outer side surface segments 40 and 42 can have various non-circular external peripheral and cross-sectional configurations and sizes as described above for inner side surface 32. It should also be appreciated that the external peripheral and cross-sectional configurations of the upper and lower outer side surface segments 40 and 42 can be different from the peripheral and cross-sectional configurations circumscribed by the upper and lower inner side surface segments 35 and 37.

The housing 18 is preferably formed integrally, unitarily or monolithically as a single part and is made from a material resistant to heat transfer or conduction to provide a thermal barrier between the cooling disc assembly 20 and the support structure 16 as explained further below. One suitable material for housing 18 is acrylic plastic and, in particular, a closed cell acrylic plastic. The housing 18 can be formed from a hollow cylinder that is machined to provide the interior and exterior stepped configurations. The housing 18 can be made of clear or transparent material, or of a material having a desired color. The housing 18 can be provided with illumination, such as fiber optic lighting, to provide an illuminating effect visible on, along or through the top surface 28. The illuminating effect may be desirable from an aesthetic standpoint due to the ambience it provides and from a utilitarian standpoint due to the function it serves in visually highlighting the cooling station 12 along the upper surface 17 of the support structure 16.

Figure 5:
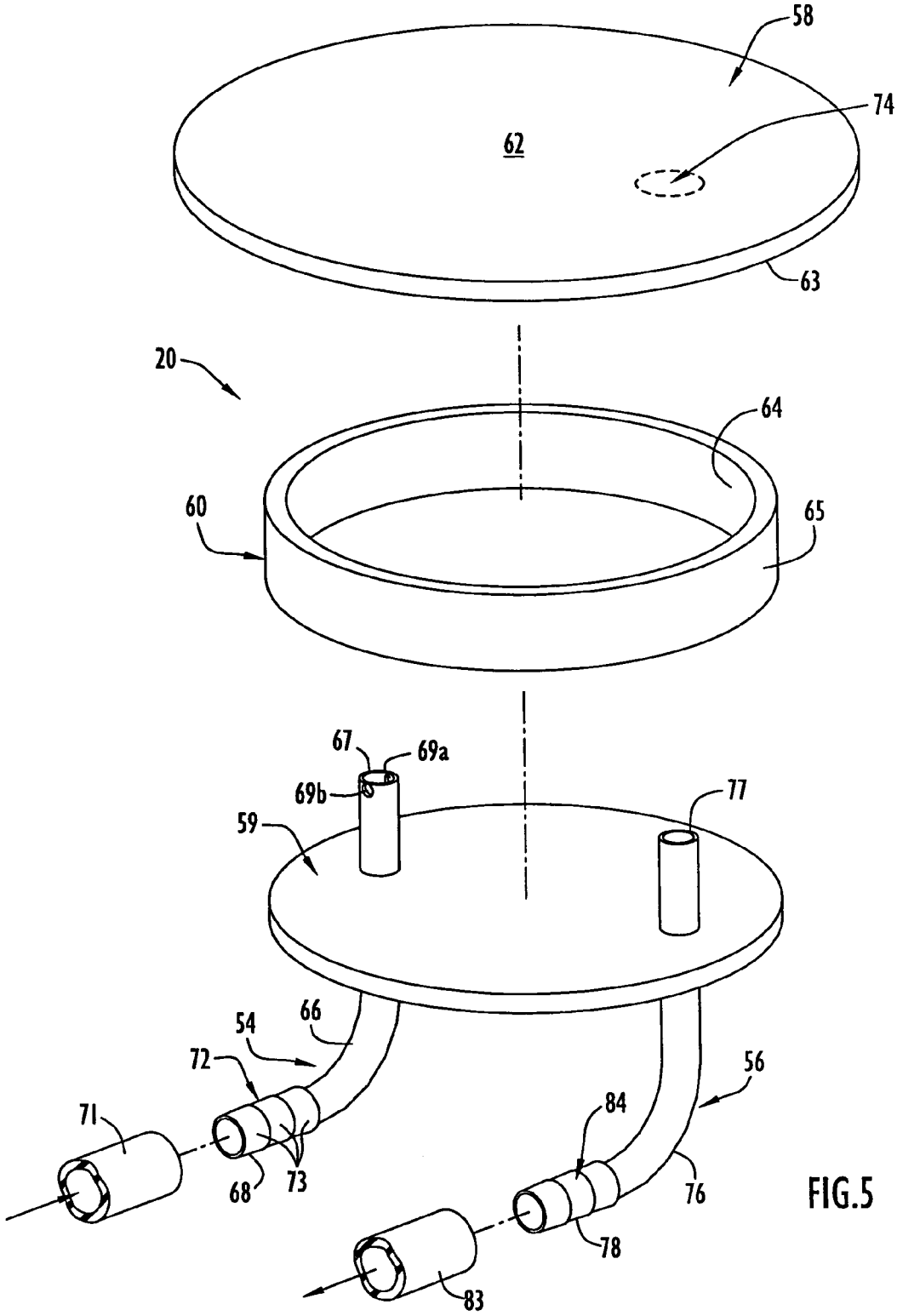
FIG. 5 is an exploded perspective view of a cooling disc assembly of the cooling station.

The cooling disc assembly 20 is best illustrated in FIGS. 3 and 5 and comprises an enclosure 50, a cooling chamber 52 within the enclosure 50 through which the chilled fluidic cooling medium from refrigeration unit 14 is circulated, a fluid inlet 54 in communication with the chamber 52, and a fluid outlet 56 in communication with chamber 52. The enclosure 50 comprises a top disc or plate 58, a bottom plate 59 and a peripheral side wall 60 connecting the bottom plate 59 to the top disc 58 to enclose the cooling chamber 52. The top disc 58 is made from a material, such as stainless steel, that is a good conductor of heat for thermal transfer with the cooling medium in chamber 52. For reasons of practicality and cost reduction, the top disc 58, the bottom plate 59 and the peripheral side wall 60 are fabricated as separate components assembled together to form a sealed or fluid-tight enclosure for chamber 52. Accordingly, it is preferable for the bottom plate 59 and the side wall 60 to be made from the same material as the top disc 58 and for the top disc 58, the bottom plate 59 and the side wall 60 to be assembled by welding. It should be appreciated, however, that the bottom plate 59 and/or the side wall 60 can be made from a material different from the material of the top disc 58 and that the top disc 58, the bottom plate 59 and the side wall 60 can be assembled in any suitable manner to form the enclosure 50. It should also be appreciated that the enclosure 50 could be fabricated integrally, unitarily or monolithically as a single component.

The top disc 58 has a perimeter of configuration and size to fit closely within the peripheral configuration circumscribed by the upper inner side surface segment 35 so that the top disc 58 is received with a close fit in the upper cavity portion 46 of cavity 26 when the cooling disc assembly 20 is mounted on the housing 18. The top disc 58 has a thickness between an upper surface or face 62 and a lower surface or face 63 of the top disc 58 selected so that the upper face 62 is flush or aligned with, or is substantially flush or aligned with, the top surface 28 of housing 18 when the top disc 58 is disposed in the upper cavity portion 46 with the lower face 63 supported on the ledge surface 36. The top disc 58 is preferably flat or planar, with upper and lower faces 62 and 63 that are planar and parallel to one another, and is preferably of uniform thickness. The perimeter of top disc 58 is complementary to the peripheral configuration and size of the upper cavity portion 46 and, therefore, the top disc 58 has a circular perimeter complementary to the circular peripheral configuration and size of upper cavity portion 46. Of course, the top disc 58 could have various perimeter configurations and/or sizes. As explained further below, the upper face 62 of top disc 58 presents a surface upon which a receptacle containing a comestible product can be rested during the course or process of the comestible product being consumed, and the upper face 62 of top disc 58 should be larger in size than the footprint of the bottom or base of the receptacle that is placed on the upper face 62. It is especially desirable, but not necessary, for the top disc 58 to have a perimeter and size such that the upper face 62 presents a surface for supporting no more than a single drinking receptacle thereon.

The side wall 60 has a top end secured in abutment with the lower face 63 of top disc 58 and has a bottom end secured in abutment with the bottom plate 59 to form the enclosure 50. The side wall 60 is of annular configuration with an inner peripheral surface 64, an outer peripheral surface 65, and a wall thickness between the inner and outer peripheral surfaces 64 and 65. The inner peripheral surface 64 peripherally circumscribes the chamber 52 and defines an inner perimeter of side wall 60. The outer peripheral surface 65 defines an outer perimeter of the side wall 60. The outer perimeter of side wall 60 is smaller than the perimeter of top disc 58 and is contained in its entirety within or inside the boundary of the perimeter of top disc 58 in spaced relation with the top disc perimeter. Accordingly, a peripheral margin of the lower face 63 is exposed and extends entirely around the outer perimeter of side wall 60 when the top end of side wall 60 is in abutment with the lower face 63 to form the enclosure 50. The peripheral margin of lower face 63 is supported on the ledge surface 36 of housing 18 when the top disc 58 is disposed in the upper cavity portion 46 of the housing, and the side wall 60 will thereby be disposed in the lower cavity portion 47 of the housing. The outer perimeter of side wall 60 is sufficiently smaller than the peripheral configuration circumscribed by the lower inner side surface segment 37 of housing 18 so that a peripheral or annular gap is presented in the lower cavity portion 47 between the outer peripheral surface 65 of the side wall 60 and the lower inner side surface segment 37 of housing 18. The side wall 60 can have any suitable annular geometric configuration extending around the chamber 52, and preferably the side wall 60 has an annular cylindrical configuration concentric with the top disc 58 and with the lower inner side surface segment 37 of housing 18. In this case, the inner and outer perimeters of side wall 60 are each circular, and the outer peripheral surface 65 of side wall 60 is spaced equidistantly from the lower inner side surface segment 37 such that the peripheral gap between the lower inner side surface segment 37 and the outer peripheral surface 65 is an annular cylindrical gap of uniform width. It should be appreciated, however, that the side wall 60 can have various peripheral configurations with inner and outer perimeters other than circular, and that the peripheral gap need not be of uniform width around the side wall 60.

The bottom plate 59 is preferably secured in overlapping abutment with the bottom end of side wall 60 such that the perimeter of the bottom plate 59 is flush or aligned with, or is substantially flush or aligned with, the outer peripheral surface 65 of side wall 60 as is depicted for enclosure 50. Accordingly, the bottom plate 59 for enclosure 50 has a circular perimeter of the same or substantially the same size as the outer perimeter of side wall 60. The perimeter of bottom plate 59 thusly forms a continuation of the side wall 60 so that the peripheral gap in cavity 26 also extends around the perimeter of bottom plate 59. It should be appreciated that the perimeter of the bottom plate 59 could have a different configuration and/or size than the outer perimeter of side wall 60. It should also be appreciated that the bottom plate 59 could be secured within the inner perimeter of side wall 60 with a close fit to be in overlapping abutment with the inner peripheral surface 64 at the bottom end of the side wall 60. The bottom plate 59 is preferably flat or planar and preferably is parallel to the top disc 58 when secured to the bottom end of the side wall 60 to form the enclosure 50. The bottom plate 59 of the enclosure 50 is spaced upwardly from the bottom surface 30 of housing 18 to be disposed within the lower cavity portion 47 when the cooling disc assembly 20 is mounted on the housing 18. Therefore, in addition to there being a peripheral gap in cavity 26 around the enclosure 20, there is a longitudinal gap in the cavity 26 between the bottom plate 59 and the bottom surface 30 of the housing 18. As explained further below, the insulation medium 22 is disposed in the peripheral and longitudinal gaps.

The cooling chamber 52 has a cross-sectional configuration and dimension corresponding to the inner perimeter of side wall 60. The cooling chamber 52 has a depth or height between the lower face 63 of top disc 58 and the upper surface of bottom plate 59. As explained further below, the lower face 63 of top disc 58 includes a shallow recess 74 formed therein at a location for the recess 74 to face into the cooling chamber 52 and to be in communication with the cooling chamber 52 at a position close to the inner peripheral surface 64 of side wall 60.

Figure 6:
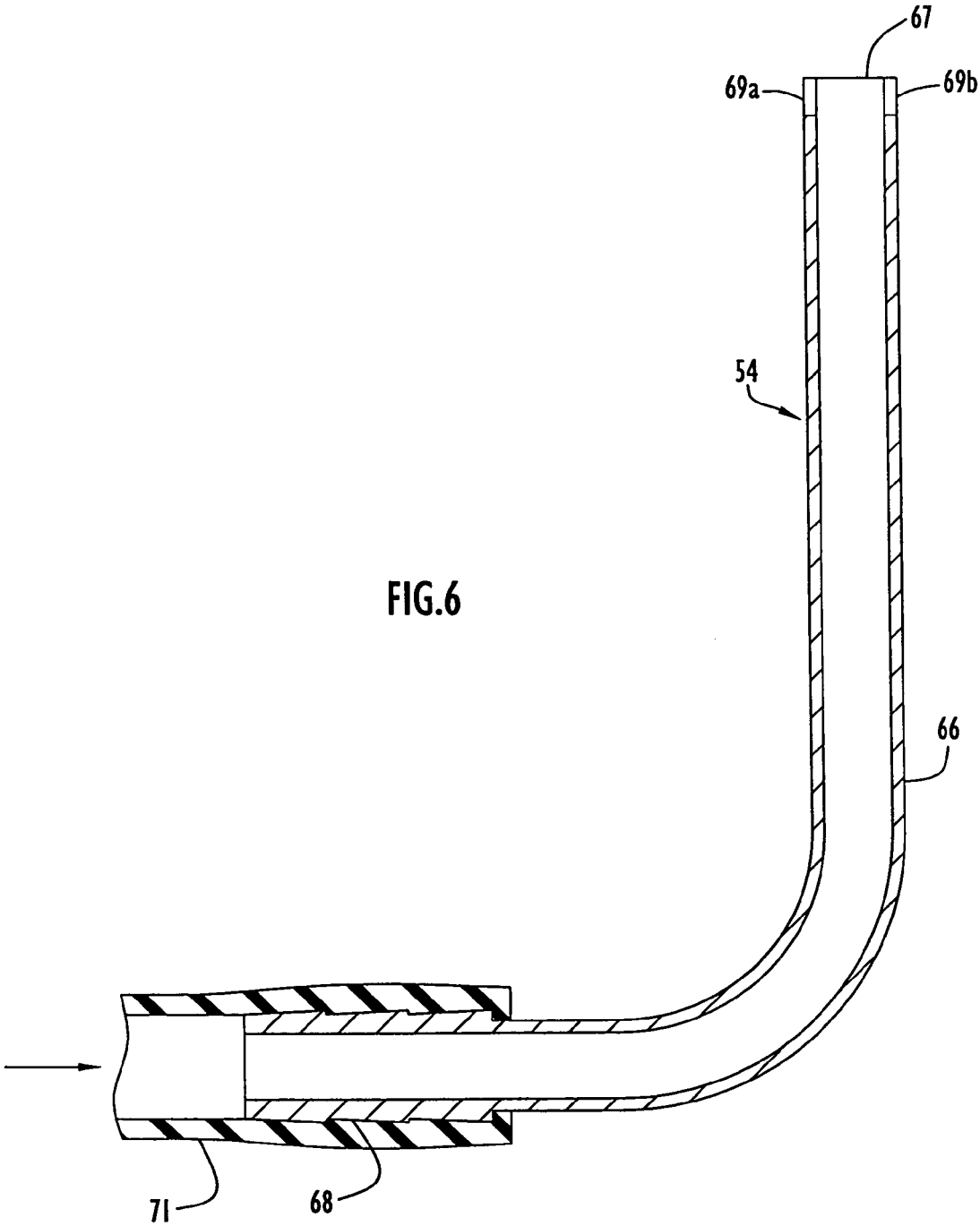
FIG. 6 is a side sectional view of an inlet tube of the cooling disc assembly.

The fluid inlet 54 in communication with cooling chamber 52 comprises an inlet tube 66 secured to enclosure 50 with a first end 67 of the inlet tube disposed in the cooling chamber 52 and a second end 68 of the inlet tube disposed externally from the bottom of the housing 18 for connection with the refrigeration unit 14 to receive a flow of chilled fluidic cooling medium from the refrigeration unit 14 to be supplied to the chamber 52. The inlet tube 66 extends through and is secured within a hole extending entirely through the thickness of bottom plate 59. The first end 67 of the inlet tube 66 is open and terminates at a terminal end surface or edge in abutment with the lower face 63 of top disc 58. Preferably, the terminal end surface of first end 67 is perpendicular to the central longitudinal axis of the inlet tube 66 and is in abutment with the lower face 63 at a location diametrically opposite or spaced 180° from the recess 74 in lower face 63. An inlet orifice 69 is provided in the inlet tube 66 at, adjacent or close to the terminal end surface of first end 67, such that the inlet orifice 69 is disposed at or substantially at the top or highest position in the cooling chamber 52. The inlet orifice 69 preferably comprises a plurality of inlet holes or apertures formed through the wall of inlet tube 66 to provide communication with the internal lumen or passage through the inlet tube 66. More preferably, the inlet orifice 69 comprises a pair of inlet holes 69*a* and 69*b* formed through the wall of inlet tube 66 at 180° spaced diametric locations as best seen in FIGS. 5 and 6. The inlet holes 69*a* and 69*b* may be identical or substantially identical to one another and may be circular as seen in FIGS. 3, 5 and 6. The inlet holes 69*a* and 69*b* may intersect the terminal end surface of first end 67. The inlet holes 69*a* and 69*b* establish communication between the lumen of the inlet tube 66 and the cooling chamber 52, and chilled fluidic cooling medium received by the second end 68 of the inlet tube 66 is supplied to the cooling chamber 52 through the inlet holes 69*a* and 69*b*.

The hole in bottom plate 59 through which the inlet tube 66 extends into the cooling chamber 52 is preferably located such that the inlet tube 66 extends within the chamber 52 alongside the inner peripheral surface 64 of side wall 60, with the exterior or outer circumferential surface of the wall of the inlet tube 66 adjacent, close to or in contact with the inner peripheral surface 64. In the case of inlet tube 66, the exterior circumferential surface is in contact with the inner peripheral surface 64 as best seen in FIG. 3. The inlet tube 66 thusly extends the entire height of the cooling chamber 52 but its location adjacent, close to or in contact with the inner peripheral surface 64 avoids or minimizes interference with the circulation of cooling medium in chamber 52. Also, the inlet tube 66 is oriented in chamber 52 so that the inner peripheral surface 64 does not overlap or cover the inlet holes 69*a* and 69*b*, which are in open communication with the chamber 52. The inlet orifice 69 presents a total inlet area through which cooling medium is supplied to the chamber 52, the total inlet area corresponding to the sum of the cross-sectional areas of the inlet holes. In the case of inlet tube 66 having two inlet holes 69*a* and 69*b*, the total inlet area corresponds to the cross-sectional area of inlet hole 69*a* plus the cross-sectional area of inlet hole 69*b*. For inlet holes 69*a* and 69*b* of circular cross-section, the cross-sectional area for each inlet hole corresponds to $\pi_r^2$.

The inlet tube 66 extends beyond a lower surface of the bottom plate 59 and exits the lower cavity portion 47 at the bottom of housing 18 so that the second end 68, which is open, is disposed externally of the housing 18. Preferably, the inlet tube 66 is formed with a bend, angle or curve between first and second longitudinally straight tube segments. The inlet tube 66 depicted for cooling disc assembly 20 has a bent, angled or curved tube segment, a first longitudinally straight tube segment extending from the curved tube segment to the terminal end surface of first end 67, and a second longitudinally straight tube segment extending from the curved tube segment to the second end 68. The first longitudinally straight tube segment of inlet tube 66 extends through the hole in bottom plate 59 and extends within the cooling chamber 52 alongside the inner peripheral surface 64 of side wall 60. When the cooling disc assembly 20 is mounted on housing 18, the first longitudinally straight tube segment of inlet tube 66 is disposed parallel to the central axis x. The curved tube segment may be a 90° or right angle curve so that the second longitudinally straight tube segment is perpendicular to the first longitudinally straight tube segment and is disposed externally of the housing 18. It is preferable that the second longitudinally straight tube segment of inlet tube 66 be close to the bottom surface 30 of housing 18 and, most preferably, that it be in close parallel or substantially parallel spaced relation to the bottom surface 30 of housing 18. Although the inlet tube 66 could be of sufficient length and could have a longitudinal configuration suitable for the second end 68 to be connected directly to an outlet port 87 of refrigeration unit 14, the second end 68 of the inlet tube 66 will more preferably be connected to the outlet port 87 of the refrigeration 14 unit via an intermediary fluid supply system 70 as depicted in FIGS. 1 and 2. It is preferable that the inlet tube 66 have a length and directional orientation, and in particular that its second longitudinally straight tube segment have a length and directional orientation, such that the second end 68 does not protrude beyond the peripheral confine or boundary of the lower outer side surface segment 42 of housing 18 when the cooling disc assembly 20 is mounted on the housing 18. Preferably, the inlet tube 66 is made from stainless steel and is secured in the hole of bottom plate 59 via welding. The inlet holes 69*a* and 69*b* may be formed in the inlet tube 66 by drilling and may be of any suitable cross-sectional configuration. The inlet tube 66 can be of variable length, wall thickness, and inner and outer diameter.

The fluid supply system 70 includes a fluid supply conduit 71 having an end for being coupled to the second end 68 of the inlet tube 66 as shown in FIG. 5 and having an opposite end for being coupled to the outlet port 87 of refrigeration unit 14 as shown in FIG. 2. As explained further below, the outlet port 87 of the refrigeration unit 14 discharges chilled fluidic cooling medium into fluid supply conduit 71, which transports the chilled fluidic cooling medium to the inlet tube 66 for conveyance into the cooling chamber 52 via the inlet orifice 69. The end of fluid supply conduit 71 can be coupled to the second end 68 of inlet tube 66 by insertion of the second end 68 into the open end of the fluid supply conduit 71, and the second end 68 of inlet tube 66 can be provided or configured with a retention device 72 to assist in retaining the end of the fluid supply conduit 71 in coupled engagement with the second end 68 of the inlet tube 66. The retention device 72 can comprise one or more tapered protuberances 73 of frustoconical configuration as depicted by way of example for retention device 72. Alternatively or in addition to retention device 72, various securing devices such as clamps or collars can be placed on the end of the fluid supply conduit 71 to secure the end of the fluid supply conduit 71 in coupled engagement with the second end 68 of the inlet tube 66 while avoiding leakage of the fluidic cooling medium from the coupling site. Any suitable conduit, including flexible conduit, can be used for the fluid supply conduit 71.

The fluid outlet 56 in communication with the cooling chamber 52 comprises an outlet tube 76 secured to enclosure 50 with a first end 77 of the outlet tube disposed in the cooling chamber 52 and a second end 78 of the outlet tube disposed externally from the bottom of the housing 18 for connection with the refrigeration unit 14 to return a flow of the fluidic cooling medium to the refrigeration unit 14 from the cooling chamber 52. The outlet tube 76 can be constructed in a manner similar to the inlet tube 66 but without the holes 69*a* and 69*b*. The outlet tube 76 extends through and is secured in a hole extending entirely through the thickness of bottom plate 59 so that the first end 77, which is open, is in alignment with the recess 74 in the lower face 63 of top disc 58. The recess 74 in top disc 58 and the hole in bottom plate 59 through which the outlet tube 76 extends into the chamber 52 are preferably located such that the outlet tube 76 extends along the inner peripheral surface 64 of side wall 60 with the exterior circumferential surface of the wall of the outlet tube 76 close to the inner peripheral surface 64 as best seen in FIG. 3. Accordingly, the location of the outlet tube 76 close to the inner peripheral surface 64 avoids or minimizes interference with the circulation of cooling medium in chamber 52.

The recess 74 in the lower face 63 of top disc 58 is defined by a top surface or ceiling 80 offset from the lower face 63 and by a peripheral side surface 81 extending from the lower face 63 to the top surface 80. The recess 74 is open along the lower face 63 to be in communication with the cooling chamber 52. The top surface 80 is disposed between the upper face 62 and the lower face 63 of top disc 58, and the top surface 80 can be planar and parallel to the upper and lower faces 62 and 63. The recess 74 has a depth or height between the lower face 63 and the top surface 80, which corresponds to the height of the peripheral side surface 81. The depth of the recess 74 is thusly disposed within and is less than the thickness of the top disc 58. The peripheral side surface 81 defines or circumscribes a peripheral configuration and size for recess 74 that is larger than the outer or exterior circumference of the outlet tube 76. The peripheral side surface 81 is disposed entirely within the inner perimeter of side wall 60 and, as depicted in FIG. 3, is preferably located close to or adjacent the inner peripheral surface 64 of side wall 60. The recess 74 can have a circular peripheral configuration as is depicted for recess 74, but other peripheral configurations are possible for the recess 74.

As best seen in FIG. 3, the outlet tube 76 is secured to enclosure 50 so that the terminal end surface or edge of open first end 77 is spaced from the top surface 80 of the recess 74, with the outer circumference of the outlet tube 76 disposed entirely within the confine or boundary of the peripheral configuration of the recess 74. The first end 77 of the outlet tube 76 is preferably centered with respect to the peripheral configuration of the recess 74. Where the recess 74 has a circular peripheral configuration, the first end 77 of the outlet tube 76 may be concentric therewith as depicted in FIG. 3. The terminal end surface of the first end 77 is preferably perpendicular to the central longitudinal axis of the outlet tube and is preferably located at the top or highest position in the cooling chamber 52 to be at the same or substantially the same level or height as the terminal end surface of the first end 67 of inlet tube 66. Since the peripheral configuration of the recess 74 is larger than the outer circumference of the outlet tube 76, and since the terminal end surface of the first end 77 of the outlet tube 76 is spaced from the top surface 80 of the recess 74, the open first end 77 of the outlet tube is in communication with the cooling chamber 52 via the recess 74. In particular, an outer peripheral margin or border of the recess 74 extends entirely around the outer circumference of the first end 77 for fluidic cooling medium to enter the recess 74 and the open first end 77 of outlet tube 76 for discharge from the cooling chamber 52. The first end 77 of the outlet tube 76 thusly comprises an outlet or discharge orifice 77 through which a discharge flow of the fluidic cooling medium exits chamber 52. The discharge orifice 77 presents a total discharge area through which fluidic cooling medium from chamber 52 is discharged, the total discharge area corresponding to the cross-sectional area, i.e. $\pi_r^2$, of the internal lumen or passage through the outlet tube 76. The total discharge area is less than the total inlet area of inlet orifice 69 and, preferably, is or is about 50% of the total inlet area.

The outlet tube 76 extends beyond the lower surface of the bottom plate 59 and exits the lower cavity portion 47 at the bottom of housing 18 so that the second end 78, which is open, is disposed externally of the housing 18. The outlet tube 76 can be configured with a bend, curve or angle between first and second longitudinally straight tube segments as described above for inlet tube 66. The outlet tube 76 for cooling disc assembly 20 has a bent, angled or curved tube segment, a first longitudinally straight tube segment extending from the curved tube segment to the terminal end surface of the first end 77, and a second longitudinally straight tube segment extending from the curved tube segment to the second end 78 as described for inlet tube 66. The first longitudinally straight tube segment of the outlet tube 76 extends through bottom plate 59 and extends within the cooling chamber 52 in parallel with the first longitudinally straight tube segment of inlet tube 66. The second longitudinally straight tube segment of the outlet tube 76 extends externally of the housing 18, preferably close to the bottom surface 30 of the housing 18 and, most preferably, in close parallel or substantially parallel spaced relation to the bottom surface 30. The curved tube segment of outlet tube 76 may be a 90° or right angle bend. The second longitudinally straight tube segment of outlet tube 76 may extend parallel with and in the same direction as the second longitudinally straight tube segment of the inlet tube 66. Although the outlet tube 76 could be designed to allow the second end 78 to be connected directly to an inlet port 88 of the refrigeration unit 14, the second end 78 will more preferably be connected to the inlet port 88 of the refrigeration unit 14 via an intermediary fluid return system 82 as depicted in FIGS. 1 and 2. It is preferable that the outlet tube 76 have a length and directional orientation, and in particular that its second longitudinally straight tube segment have a length and directional orientation, such that the second end 78 does not protrude beyond the peripheral confine or boundary of the lower outer side surface segment 42 of housing 18 when the cooling disc assembly 20 is mounted on the housing 18. Preferably, the outlet tube 76 is made from stainless steel and is secured to the enclosure 50 by welding. The outlet tube 76 can be of variable length, wall thickness, and inner and outer diameters.

The fluid return system 82 includes a fluid return conduit 83 having an end for being coupled with the second end 78 of the outlet tube 76 as shown in FIG. 5 and having an opposite end for being coupled with the inlet port 88 of the refrigeration unit 14 as shown in FIG. 2. As explained further below, fluidic cooling medium is discharged from the chamber 52 into the outlet tube 76 and is conveyed by the fluid return conduit 83 to the inlet port 88 of the refrigeration unit 14. The second end 78 of the outlet tube 76 can be provided or configured with a retention device 84, which may be similar to the retention device 72, to assist in retaining the second end 78 in coupled engagement with the end of the fluid return conduit 83 as described above for inlet tube 66. Furthermore, various securing devices can be placed on the end of the fluid return conduit 83 to secure the end of the fluid return conduit in coupled engagement with the second end 78 of outlet tube 76 as described above for inlet tube 66. Any suitable conduit, including flexible conduit, can be used for the fluid return conduit 83.

In a representative but not limiting embodiment, the housing 18 has an overall height between the top surface 28 and the bottom surface 30 of or about 1.5 inches; the upper outer side surface segment 40, which defines the external collar, has a height between top surface 28 and shoulder surface 41 of or about 0.5 inch; the upper outer side surface segment 40 has a diameter of or about 4.5 inches; the lower outer side surface segment 42 has a diameter of or about 4.25 inches; the upper cavity portion 46 has a diameter of or about 4.0 inches and a depth of or about 0.125 inch; the lower cavity portion 47 has a diameter of or about 3.75 inches; the top disc 58 has a diameter of or about 4.0 inches and a thickness of or about 0.125 inch; the side wall 60 has an inner diameter of or about 2.75 inches, which corresponds to the diameter of the chamber 52; the side wall 60 has an outer diameter of or about 3.0 inches; the side wall 60 has a height of or about 0.25 inch, which corresponds to the height of chamber 52; the bottom plate 59 has a diameter of or about 3.0 inches and a thickness of or about 0.125 inch; the inlet tube 66 has an outer diameter of or about 0.375 inch and an inner diameter of or about 0.250 inch; each inlet hole 69*a* and 69*b* has a diameter of or about 0.125 inch; the inlet orifice 69 has a total cross-sectional inlet area of or about 0.024 square inches; the outlet tube 76 has an outer diameter of or about 0.25 inch and an inner diameter of or about 0.125 inch; the discharge orifice 77 has a total cross-sectional discharge area of or about 0.012 square inches; the recess 74 has a diameter of or about 0.50 inch and a height of or about 0.06 inch; the curved tube segments of the inlet tube 66 and the outlet tube 76 have a radius of curvature of or about 0.50 inch; and the protuberances of the retention devices 72 each have a length of or about 0.17 inch and a taper angle of or about 3°. Generally speaking, it is preferable but not essential for the cooling chamber 52 to have a height equal or about equal to the inner diameter of the inlet tube 66; for the cooling chamber to have a height equal or about equal to the sum of the diameters of the inlet holes; for the side wall 60 to have an outer perimeter in the range of ½ to 2 inches smaller than the outer perimeter of the top disc 58; and for the total cross-sectional discharge area to be 50% or about 50% of the total cross-sectional inlet area.

The cooling disc assembly 20 is mounted on the housing 18 by positioning the top disc 58 of the cooling disc assembly in the upper cavity portion 46 of the housing so that the peripheral margin of lower face 63 rests or is supported on the ledge surface 36 of the housing 18. The upper face 62 of top disc 58 will be aligned or flush with, or substantially aligned or flush with, the top surface 28 of the housing 18. The cooling chamber 52 will be disposed within the lower cavity portion 47 of the housing 18, with the peripheral gap being presented in the lower cavity portion 47 between the enclosure 20 and the lower inner side surface segment 37 of the housing. Also, the longitudinal gap is presented in the lower cavity portion 47 between the bottom plate 59 and the bottom of the housing 18. The insulation medium 22 is supplied to the peripheral and longitudinal gaps presented in the lower cavity portion 47 to fill or substantially fill the vacant area of the lower cavity portion 47. The insulation medium 22 is preferably a foam insulation medium, such as a urethane foam, supplied to the vacant area in a fluidic form by spraying and which thereafter cures in place to form a solidified or hardened mass of insulation medium 22 that is adhesively bonded to the housing 18 and the cooling disc assembly 20. Accordingly, the housing 18 and cooling disc assembly 20 are held together structurally by the hardened mass of insulation medium 22. The inlet tube 66 and the outlet tube 76 extend from the hardened mass of insulation medium 22 and from the bottom of housing 18 so that the second ends 68 and 78 thereof are disposed externally of the housing for connection with the refrigeration unit 14.

The refrigeration unit 14, as shown in FIGS. 1 and 2, can be any suitable refrigeration unit or "chiller" having a cooling mechanism 86 for cooling or chilling a fluidic cooling medium, such as glycol, an outlet port 87 through which the chilled fluidic cooling medium is discharged from the refrigeration unit, a pump (not shown) for causing the chilled fluidic cooling medium to be discharged under pressure from the outlet port 87, and an inlet port 88 through which the fluidic cooling medium reenters the refrigeration unit for return to the cooling mechanism 86. The refrigeration unit 14 is preferably of a size to fit beneath the support structure 16 and, in particular, to fit beneath a standard bar top. The fluidic cooling medium of the refrigeration unit 14 is one that remains in a fluidic state when chilled to temperatures well below freezing temperature. A preferred fluidic cooling medium is glycol and, in particular, polyglycol or propylene glycol. The refrigeration unit 14 is preferably capable of chilling the fluidic cooling medium to an average temperature of or about 18° F. and of discharging a flow of the chilled fluidic cooling medium at a pressure in the range of or about 10-15 psi or greater. It is preferred that the refrigeration unit 14 have a temperature control mechanism, such as a thermostat, for electronically controlling the temperature to which the fluidic cooling medium is chilled. The temperature control mechanism allows the cooling mechanism 86 to be set to chill the fluidic cooling medium to a desired temperature and regulates the cooling mechanism to maintain the desired temperature without requiring adjustments made by human intervention. It is also preferred that the refrigeration unit 14 be self-defrosting, with programmed defrost cycles so that frost build-up does not have to be scraped off of the cooling mechanism 86. The refrigeration unit 14 can have an automatic control switch that can be set to turn off the refrigeration unit 14 and/or to stop the discharge of chilled fluidic cooling medium from the refrigeration unit 14 at a desired time. Accordingly, when the cooling apparatus 10 is used in a bar or similar establishment, it can be set to turn off or shut down automatically at a time when the bar or similar establishment is closed for business or operation. The refrigeration unit 14 can be powered electrically and will typically have a power cord with a plug for being plugged into a conventional wall outlet. Various commercially available refrigeration units or "chillers" can be used for the refrigeration unit 14, and those that are low maintenance and easy to use are especially advantageous.

The cooling station 10 is installed in a hole or passage 90 formed through the thickness of support structure 16 and having a configuration and size to receive the housing 18. The passage 90 can be formed in the support structure 16 by cutting the support structure or in any suitable manner depending on the materials and/or construction of the support structure. The passage 90 formed in support structure 16 has a stepped configuration to provide an internal surface 91 within the thickness of the support structure 16 on which the shoulder surface 41 of housing 18 is supported as illustrated in FIG. 3. The internal surface 91 is recessed from the upper surface 17 of the support structure 16 so that the top surface 28 of housing 18 is flush or aligned with, or is substantially flush or aligned with, the upper surface 17 when the shoulder surface 41 is supported on the internal surface 91. Preferably, the passage 90 is formed in support structure 16 to have an upper passage portion complementary to the external peripheral or cross-sectional configuration defined by the upper outer side surface segment 40 of housing 18 and to have a lower passage portion complementary to the external peripheral or cross-sectional configuration defined by the lower outer side surface segment 42 of housing 18 so that the housing 18 is received in the passage 90 with a close complementary or mating fit. A caulk can be provided around the outer top peripheral edge 43 of the housing 18 to provide continuity between the upper surface 17 of the support structure 16 and the top surface 28 of the housing 18, to prevent the entry of fluids and other substances between the housing 18 and the support structure 16, and for an enhanced aesthetic appearance. The second end 68 of inlet tube 66 and the second end 78 of the outlet tube 76 will be exposed and accessible from beneath the support structure 16 and are respectively connected to the outlet port 87 and the inlet port 88 of the refrigeration unit 14. In particular, the second end 68 of inlet tube 66 is connected to one end of the fluid supply conduit 71, and an opposite end of the fluid supply conduit 71 is connected to the outlet port 87 of the refrigeration unit 14. Similarly, the second end 78 of the outlet tube 76 is connected to one end of the fluid return conduit 83, and the opposite end of the fluid return conduit is connected to the inlet port 88 of the refrigeration unit 14.

Each cooling station 12 is installed in the support structure 16 in a similar manner. In a typical bar top, five or more cooling stations 12 will usually be installed. The inlet tube 66 for each cooling station 12 can have its second end 68 connected to the outlet port 87 of the refrigeration unit 14 via a separate fluid supply conduit 71 of fluid supply system 70. In order to connect the ends of a plurality of fluid supply conduits 71 to the outlet port 87, the outlet port 87 can be associated with an inlet manifold having a plurality of connection ports for the fluid supply conduits. Similarly, the outlet tube 76 for each cooling station 12 can have its second end 78 connected to the inlet port 88 of the refrigeration unit 14 via a separate fluid return conduit 83, and the inlet port 88 can be associated with a return manifold having a plurality of connection ports for the individual fluid return conduits.

Once the fluid inlet 54 and the fluid outlet 56 of each cooling station 12 have been connected respectively to the outlet port 87 and the inlet port 88 of the refrigeration unit 14, the refrigeration unit 14 is placed in operation to begin pumping the chilled fluidic cooling medium 92, which preferably has been chilled by the cooling mechanism 86 to about 18° F. as an example, through the outlet port 87 for flow through each fluid supply conduit 71 and the corresponding inlet tube 66 into the cooling chamber 52 of each cooling station 12 as depicted in FIG. 3. The chilled fluidic cooling medium 92 enters the cooling chamber 52 through the inlet orifice 69 comprising the inlet holes 69*a* and 69*b*. Each cooling chamber 52 and its recess 74 are thusly filled with the chilled fluidic cooling medium 92, which is in direct contact with the lower face 63 of the top disc 58. The chilled fluidic cooling medium 92 enters the chamber 52 through the inlet holes 69*a* and 69*b* as two oppositely directed jet streams, which provide motive force to churn and agitate the fluidic cooling medium to promote circulation of the fluidic cooling medium 92 in chamber 52. Each cooling chamber 52 presents a relatively wide, open area in which the fluidic cooling medium 92 can freely circulate at random. The continuous flow of chilled fluidic cooling medium 92 into each chamber 52 results in a continuous discharge flow of the fluidic cooling medium 92 from each chamber 52 through the discharge orifice 77. Due to the reduced size of the total cross-sectional discharge area in comparison with the total cross-sectional inlet area, the discharge orifice 77 provides a restricted or metered discharge flow of the fluidic cooling medium 92 from the cooling chamber 52. Since the chilled fluid cooling medium 92 enters the chamber 52 through an inlet orifice 69 presenting a larger size total cross-sectional inlet area and is discharged from the chamber 52 through a discharge orifice 77 presenting a smaller size total cross-sectional discharge area, a positive internal pressure is maintained in the chamber 52 which also promotes circulation of the fluidic cooling medium 92 in the chamber 52 and uniform contact between the fluidic cooling medium 92 and the lower face of top disc 58. By restricting or metering the discharge flow of cooling medium 92 from the cooling chamber 52, the fluidic cooling medium 92 is allowed to circulate longer within the cooling chamber 52 for greater efficiency. Furthermore, the position of the recess 74 over the discharge orifice 77, which is at the top or highest position in the cooling chamber 52, causes any air pockets or bubbles within the cooling chamber 52 and/or the fluidic cooling medium 92 to be directed into the recess 74 and removed through the discharge orifice 77 to ensure that the portion of the lower face of top disc 58 that is disposed over the cooling chamber 52 is uniformly and evenly contacted or "wetted" by the chilled fluidic cooling medium 92. The restricted or metered discharge orifice 77 also provides protection against "skin freeze" on top disc 58 by limiting heat absorption from the top disc 58 to an amount less than the heat that the skin produces. The fluidic cooling medium 92 that is discharged from each chamber 52 through its discharge orifice 77 is conveyed through the corresponding outlet tube 76 and fluid return conduit 83 to the inlet port 88 of the refrigeration unit for return to the cooling mechanism 86 in order to be rechilled by the cooling mechanism, for example to a temperature of about 18° F. The rechilled fluidic cooling medium 92 is circulated back to each cooling station 12 in a continuous cycle.

Figure 7:
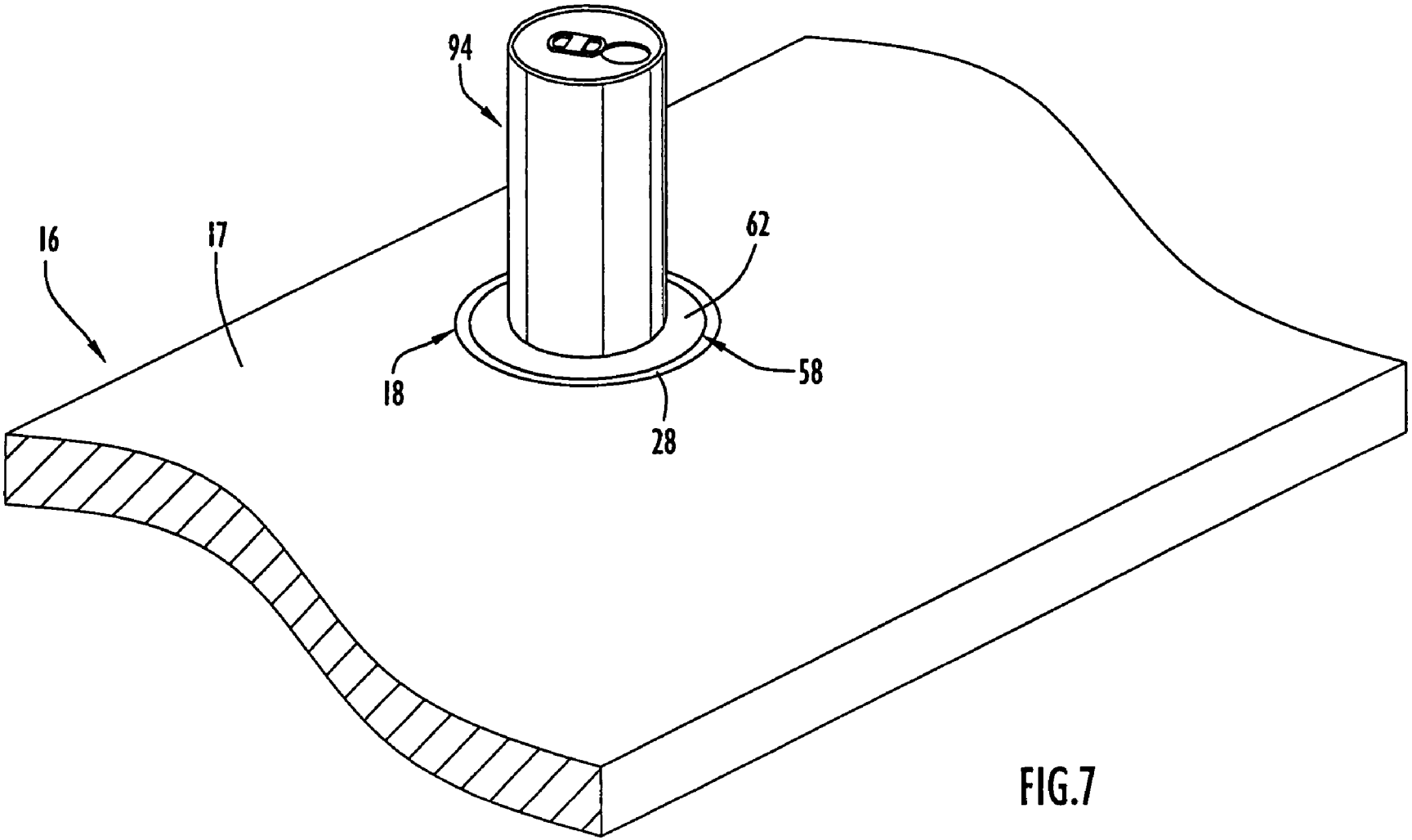
FIG. 7 is a broken perspective view of the cooling apparatus of FIG. 1 depicting an individual cooling station with a drinking receptacle rested therein.

The top disc 58 of each cooling station 12 serves as a thermal reducer, and the upper face 62 of each top disc 58 provides a heat transfer surface along the upper surface 17 of the support structure 16 upon which a receptacle containing a comestible product can be rested during the course or process of the comestible product being consumed. Due to the lower face 63 of each top disc 58 being contacted or "wetted" by the chilled fluidic cooling medium 92 within the corresponding chamber 52, the temperature of the top disc 58 and its upper face 62 are lowered, such that heat is absorbed or transferred from the comestible product that has been placed on the upper face 63. As depicted in FIG. 7, each cooling station 12 is particularly advantageous for supporting a drinking receptacle 94 containing a cooled beverage, such as a can containing beer or soda, rested upon the upper face 62 of top disc 58 during the course or process of the beverage being consumed. Throughout the course or process of the beverage being consumed, the cooled state of the beverage is maintained due to thermal transfer with the top disc 58. The very low temperature of the fluidic cooling medium 92 allows the beverage to be maintained at a very low temperature throughout the entire course or process of the beverage being consumed. The amount of heat transfer from the beverage will depend upon the temperature of the chilled fluidic cooling medium 92 in chamber 52, and typically the cooling apparatus 10 will be operated in the range of 10-34° F. For most bar applications, it will be desirable for the cooling stations 12 to maintain an average temperature of about 24° F. As explained above, "skin freeze" on the upper face 62 of top disc 58 is limited or avoided in the cooling stations 12. "Sweating" or condensation on the upper face 62 of top disc 58 is also limited or avoided in the cooling stations 12, and any condensation that does occur can simply be wiped away from the top disc 58. The external housing 18 of each cooling station 12 forms a thermal barrier around its cooling chamber 52 and top disc 58, which limits or avoids heat transfer from the support structure 16 to the cooling disc assembly and assists in maintaining the top disc 58 at a very cold temperature with high efficiency. The insulation medium 22 within the cavity 26 of each housing 18 provides another thermal barrier around the cooling chamber 52. In addition to the functional benefits of the cooling stations 12 described above, it should be recognized that the cooling stations 12 have the additional benefits of providing a more unique and more exciting experience for patrons of bars and similar establishments.

It should be appreciated that the inlet tube 66 and the outlet tube 76 of the cooling stations 12 can be designed in various ways to provide a metered or restricted discharge orifice to obtain a metered or restricted discharge flow of the fluidic cooling medium 92 from the cooling chamber 52. It should also be appreciated that the top disc 58 can be configured to form a well or recess along the upper surface 17 of the support structure 16 to partially or entirely cradle or envelop the receptacle placed thereon. The cooling stations 12 may be used to support various receptacles other than drinking receptacles and may be used to maintain a chilled state for various products other than beverages. In addition to maintaining comestible products in a cooled state during the course or process of being consumed, the cooling stations 12 are useful for various other applications.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A cooling apparatus for installation in a support structure having a support surface for supporting a receptacle holding a comestible product, comprising one or more cooling stations embedded in the support structure, each of said cooling stations comprising a housing for being installed in the support structure and a cooling disc assembly mounted on said housing, said housing for each of said cooling stations including a top surface for being disposed along the support surface of the support structure, and a cavity within said housing and extending through said housing from a top of said housing to a bottom of said housing, said cooling disc assembly for each of said cooling stations including an enclosure for being received in said cavity of said housing and enclosing an interior space forming a cooling chamber within said enclosure, a fluid inlet entering said enclosure providing communication into said cooling chamber, and a fluid outlet exiting said enclosure providing communication out of said cooling chamber, said enclosure including a top disc, a bottom plate, and a peripheral side wall connecting said top disc to said bottom plate to enclose said cooling chamber, said top disc having an upper face for being disposed along the support surface of the support structure when said cooling disc assembly is mounted on said housing with said enclosure received in said cavity of said housing, and said top disc having a lower face, said cooling chamber being peripherally circumscribed by said side wall and extending from bottom to top between an upper surface of said bottom plate and said lower face of said top disc, said fluid inlet having an inlet orifice located within said cooling chamber and at said top of said cooling chamber through which a flow of chilled fluidic cooling medium is supplied to within said cooling chamber, wherein said fluid inlet for each of said cooling stations comprises an inlet tube extending through said bottom plate and having a terminal end surface in abutment with said lower face of said too disc, said inlet orifice for each of said cooling stations includes one or more inlet holes formed through said inlet tube adjacent said terminal end surface, said top disc for each of said cooling stations includes a recess in said lower face in communication with said cooling chamber, said fluid outlet having a discharge orifice located within said cooling chamber and at said top of said cooling chamber through which fluidic cooling medium from within said cooling chamber is discharged, wherein said fluid outlet for each of said cooling stations comprises an outlet tube extending through a hole in said bottom plate and having an open end disposed in said cooling chamber adjacent said recess to define said discharge orifice, said upper face of said top disc providing a surface for supporting the receptacle holding the comestible product, said top disc providing thermal transfer from the comestible product to the chilled fluidic cooling medium in said cooling chamber.

2. The cooling apparatus recited in claim 1 wherein said housing for each of said cooling stations has an inner side surface peripherally circumscribing said cavity, said inner side surface includes a ledge surface between said top surface of said housing and a bottom surface of said housing, said cavity includes an upper cavity portion between said top surface and said ledge surface for receiving said top disc with said lower face of said top disc supported on said ledge surface, said cavity includes a lower cavity portion between said ledge surface and said bottom surface of said housing for receiving said cooling chamber.

3. The cooling apparatus recited in claim 2 wherein said housing for each of said cooling stations is made of a material providing a thermal barrier around said enclosure.

4. The cooling apparatus recited in claim 3 wherein said enclosure for each of said cooling stations is made of stainless steel, and said housing for each of said cooling stations is made of acrylic plastic.

5. The cooling apparatus recited in claim 2 wherein said lower cavity portion of said housing for each of said cooling stations presents a peripheral gap between said inner side surface of said housing and said peripheral side wall of said enclosure and presents a longitudinal gap between said bottom plate of said enclosure and said bottom surface of said housing, and further including an insulation medium at least substantially filling said peripheral gap and said longitudinal gap.

6. The cooling apparatus recited in claim 5 wherein said insulation medium comprises a urethane foam.

7. The cooling apparatus recited in claim 1 wherein said inlet orifice for each of said cooling stations presents a total cross-sectional inlet area, and said discharge orifice for each of said cooling stations presents a total cross-sectional discharge area that is about 50% the size of said total cross-sectional inlet area.

8. The cooling apparatus recited in claim 1 and further including a refrigeration unit connected to each of said cooling stations for supplying the chilled fluidic cooling medium to said fluid inlet of each of said cooling stations and for receiving fluidic cooling medium from said fluid outlet of each of said cooling stations.

9. A cooling apparatus for installation in a support structure having a support surface for supporting a receptacle holding a comestible product comprising one or more cooling stations embedded in the support structure, each of said cooling stations comprising a housing for being installed in the support structure and a cooling disc assembly mounted on said housing, said housing for each of said cooling stations including a top surface for being at least substantially aligned with the support surface of the support structure, and a cavity within said housing and extending through said housing from a top of said housing to a bottom of said housing, said cooling disc assembly for each of said cooling stations including an enclosure for being received in said cavity of said housing and enclosing an interior space forming a cooling chamber within said enclosure, a fluid inlet providing communication into said cooling chamber for a flow of fluidic cooling medium, and a fluid outlet providing communication out of said cooling chamber for a flow of fluidic cooling medium, said enclosure including a top disc, a bottom plate, and a peripheral side wall connecting said top disc to said bottom plate to enclose said cooling chamber, said top disc having an upper face for being at least substantially aligned with said top surface of said housing when said cooling disc assembly is mounted on said housing with said enclosure received in said cavity of said housing, and said top disc having a lower face, said fluid inlet having an inlet orifice in communication with said cooling chamber through which a flow of chilled fluidic coaling medium flows into said cooling chamber to fill said cooling chamber, wherein said fluid inlet for each of said cooling stations comprises an inlet tube extending through said bottom plate and having a terminal end surface in abutment with said lower face of said top disc, said inlet orifice for each of said cooling stations includes one or more inlet holes formed through said inlet tube adjacent said terminal end surface, said top disc for each of said cooling stations includes a recess in said lower face in communication with said cooling chamber, said fluid outlet having a discharge orifice in communication with said cooling chamber through which fluidic cooling medium said cooling chamber, wherein said fluid outlet for each of said cooling stations comprises an outlet tube extending through a hole in said bottom plate and having an open end disposed in said cooling chamber adjacent said recess to define said discharge orifice, said inlet orifice having a total cross-sectional inlet area and said discharge orifice having a total cross-sectional discharge area less than said total cross-sectional inlet area to restrict the flow of the fluidic cooling medium said waling chamber in relation to the flow of the fluidic cooling medium into said cooling chamber and create a positive internal pressure within said cooling chamber, said upper face of said top disc providing a surface for supporting the receptacle holding the comestible product, said top disc providing thermal transfer from the comestible product to the chilled fluidic coaling medium in said cooling chamber.

10. The cooling apparatus recited in claim 9 wherein said open end of said outlet tube is disposed in said cooling chamber in alignment with said recess at substantially the same height in said cooling chamber as said terminal end surface.

11. The cooling apparatus recited in claim 10 wherein said open end of said outlet tube has an inner diameter, and each of said inlet holes of said inlet tube has a diameter substantially the same as said inner diameter.

12. The cooling apparatus recited in claim 9 wherein said cooling chamber has a circular configuration in cross-section between said top disc and said bottom plate, said in let tube and said outlet tube for each of said cooling stations are disposed in said cooling chamber at diametrically opposite locations, and said inlet holes are formed in said inlet tube at 180° spaced locations.

13. The cooling apparatus recited in claim 9 wherein each of said cooling stations further comprises an insulation medium disposed in said cavity around said cooling chamber.

14. The cooling apparatus recited in claim 13 wherein said housing for each of said cooling stations is secured to said cooling disc assembly by said insulation medium.

15. The cooling apparatus recited in claim 9 and further including a refrigeration unit connected to each of said cooling stations for supplying a chilled fluidic cooling medium to said fluid inlet of each of said cooling stations and for receiving fluidic cooling medium from said fluid outlet of each of said cooling stations.

16. A cooling apparatus for installation in a support structure having a support surface tar supporting a receptacle holding a comestible product comprising a refrigeration unit having a supply of a fluidic cooling medium, a cooling mechanism for chilling the fluidic cooling medium, an outlet port for discharging a flow of said fluidic cooling medium chilled by said cooling mechanism, and an inlet port for receiving a flow of said fluidic cooling medium for return to said chilling mechanism; and a plurality of cooling stations embedded in the support structure, each of said cooling stations comprising a housing for being installed in the support structure and a cooling disc assembly mounted on said housing, said housing for each of said cooling stations including a top surface for being disposed along the support surface of the support structure, and a cavity within said housing and extending through said housing from a top of said housing to a bottom of said housing, said cooling disc assembly for each of said cooling stations including an enclosure for being received in said cavity of said housing and enclosing an interior space forming a cooling chamber within said enclosure, an inlet tube having a first end with an inlet orifice secured in communication with said cooling chamber and having a second end coupled to said outlet port of said refrigeration unit for supplying the flow of said fluidic cooling medium to fill said cooling chamber, and an outlet tube having a first end with a discharge orifice secured in communication with said cooling chamber and having a second end coupled to said inlet port of said refrigeration unit for supplying a flow of said fluidic cooling medium from said cooling chamber to said refrigeration unit for return to said cooling mechanism for re-chilling in a continuous cycle, said enclosure including a top disc having a planar upper face providing a surface for supporting the receptacle holding the comestible product and having a lower face in contact with said chilled fluidic cooling medium in said cooling chamber, said top disc providing thermal transfer from the comestible product to said chilled fluidic cooling medium in said cooling chamber, said enclosure including a bottom plate, wherein said inlet tube extends through said bottom plate and has a terminal end surface in abutment with said lower face of said too disc, said inlet orifice for each of said cooling stations includes one or more inlet holes formed through said inlet tube adjacent said terminal end surface, said top disc for each of said cooling stations includes a recess in said lower face in communication with said cooling chamber, and said outlet tube extends through a hole in said bottom plate and has an open end disposed in said cooling chamber adjacent said recess to define said discharge orifice.

17. The cooling apparatus recited in claim 16 and further including a fluid supply system comprising a fluid supply conduit for each of said cooling stations, each of said fluid supply conduits having ends respectively connected to said second end of said inlet tube of said cooling station and to said outlet port of said refrigeration unit, and further including a fluid return system comprising a fluid return conduit for each of said cooling stations, each of said fluid return conduits having ends respectively connected to said second end of said outlet tube of said cooling station and to said inlet port of said refrigeration unit.

18. The cooling apparatus recited in claim 16 wherein said cooling mechanism is capable of chilling said fluidic cooling medium to an average temperature of about 18° F.

19. The cooling apparatus recited in claim 16 wherein said fluidic cooling medium is a fluidic glycol.

* * * * *